US008992211B2

(12) United States Patent
Kociecki et al.

(10) Patent No.: US 8,992,211 B2
(45) Date of Patent: Mar. 31, 2015

(54) HOT SURFACE IGNITER ADAPTIVE CONTROL METHOD

(75) Inventors: John Kociecki, Powell, OH (US); Yelena N. Kaplan, Columbus, OH (US)

(73) Assignee: Robertshaw US Holding Corp., Carol Stream, IL (US)

( * ) Notice: Subject to any disclaimer, the term of this patent is extended or adjusted under 35 U.S.C. 154(b) by 2034 days.

(21) Appl. No.: 12/144,789

(22) Filed: Jun. 24, 2008

(65) Prior Publication Data

US 2009/0317755 A1 Dec. 24, 2009

(51) Int. Cl.
*F23Q 7/22* (2006.01)
*F23Q 7/26* (2006.01)
*F23Q 7/24* (2006.01)

(52) U.S. Cl.
CPC ..... *F23Q 7/24* (2013.01); *F23N 2027/02* (2013.01); *F23N 2027/42* (2013.01)
USPC ..... 431/66; 431/69; 431/67

(58) Field of Classification Search
USPC ..... 431/66, 57, 69, 72, 6, 258, 262, 71, 74, 431/67; 236/1 A, 11, 15 BD, 15 BG
See application file for complete search history.

(56) References Cited

U.S. PATENT DOCUMENTS

| | | | | | |
|---|---|---|---|---|---|
| 2,198,556 | A | * | 4/1940 | Cunningham | 431/29 |
| 4,099,906 | A | * | 7/1978 | Pinckaers | 431/66 |
| 4,448,171 | A | * | 5/1984 | Ninomiya et al. | 123/406.23 |
| 4,615,282 | A | | 10/1986 | Brown | |
| 4,643,668 | A | | 2/1987 | Geary | |
| 4,711,628 | A | * | 12/1987 | Geary | 431/31 |
| 4,746,284 | A | | 5/1988 | Geary | |
| 4,755,132 | A | | 7/1988 | Geary | |
| 4,842,510 | A | * | 6/1989 | Grunden et al. | 431/19 |
| 4,856,983 | A | | 8/1989 | Geary | |
| 4,925,386 | A | | 5/1990 | Donnelly et al. | |
| 4,931,975 | A | | 6/1990 | Gleason, III et al. | |
| 4,955,806 | A | | 9/1990 | Grunden et al. | |
| 4,976,605 | A | | 12/1990 | Geary | |
| 4,978,292 | A | * | 12/1990 | Donnelly et al. | 431/75 |
| 4,997,361 | A | | 3/1991 | Geary | |
| 5,085,573 | A | | 2/1992 | Geary | |
| 5,233,959 | A | * | 8/1993 | Kojima | 123/406.55 |
| 5,416,300 | A | * | 5/1995 | Hickl et al. | 219/262 |
| 5,567,144 | A | | 10/1996 | McCoy | |

(Continued)

FOREIGN PATENT DOCUMENTS

| | | |
|---|---|---|
| EP | 0 321 926 B1 | 12/1993 |
| EP | 0 385 910 B1 | 6/1996 |

*Primary Examiner* — Steven B McAllister
*Assistant Examiner* — Desmond C Peyton
(74) *Attorney, Agent, or Firm* — Reinhart Boerner Van Deuren P.C.

(57) ABSTRACT

An adaptive gaseous fuel ignition control method for use in consumer and commercial appliances that reduces stress on and increases the life of a hot surface igniter without resulting in a failure to ignite condition is provided. The method provides a preheating period, a full temperature period, and a trial for ignition period. The preheating period gradually increases the power applied to reduce the stress resulting therefrom. Once a gas valve has been commanded open, the controller monitors the time for ignition of the gaseous fuel. If the time is longer than a threshold, either the applied power or the period of time during which the power is applied is increased to shorten the time. If, however, the ignition period is shorter than the threshold, either the power applied or the period of time during which the power is applied before commanding the gas valve open is lowered or shortened.

16 Claims, 7 Drawing Sheets

(56) References Cited

U.S. PATENT DOCUMENTS 6,474,979 B1 * 11/2002 Rippelmeyer ..... 431/67
6,521,869 B1 * 2/2003 Donnelly et al. ..... 219/263
6,572,363 B1 6/2003 Virgil, Jr. et al.
6,985,080 B2 1/2006 Kociecki et al.
7,148,454 B2 * 12/2006 Chodacki et al. ..... 219/497
7,671,305 B2 * 3/2010 Chodacki et al. ..... 219/497

* cited by examiner

HOT SURFACE IGNITER ADAPTIVE CONTROL METHOD

FIELD OF THE INVENTION

The present invention relates generally to ignition control systems for gas appliances, and more particularly to control systems and methods for hot surface ignition of gaseous fuel in a gas burning appliance.

BACKGROUND OF THE INVENTION

Consumer and commercial gas burning appliances, such as furnaces, hot water heaters, etc., combust gaseous fuel, e.g., natural gas, propane, etc., to generate heat to heat air or water. The ignition control systems for such gas burning appliances typically use a glow plug or hot surface igniter to ignite the gas released from a gas control valve into the combustion chamber. Such control systems typically include a flame sensor and circuitry that is utilized by the controller to detect the presence of flame and ensure safe operation of the gas burning appliance. That is, the controller will monitor the flame sense circuitry after the gas valve has been commanded open to ensure that ignition of the gas has occurred before an unsafe amount of gaseous fuel has been released through the gas control valve. This period of time varies by manufacturer, but may be within the range of four to seven seconds. If no ignition has occurred prior to the expiration of the timeout period, the gas control valve will be commanded closed, and the controller will allow for a purge time to expire before attempting to restart the burner.

Since the release and build up of un-ignited gaseous fuel presents a safety concern of explosion, typical ignition control systems drive the hot surface igniter with a voltage sufficient to generate a high enough temperature to ensure ignition of the released gaseous fuel. Many control systems allow for a short period of time to pass once the hot surface igniter has been energized to ensure that its surface temperature has achieved a sufficient temperature to ignite the gaseous fuel before opening the gas control valve.

The problems with many conventional ignition control systems, however, are two-fold. First, turning on energization to a hot surface igniter creates great thermal and mechanical stress in the device as the power is applied at a high voltage level and the temperature of the device rapidly increases to its maximum temperature. Such rapid heating and sustained high temperature operation results in premature failure of the hot surface igniter, greatly increasing the total cost of ownership of such appliances as well as decreasing customer satisfaction. Second, such conventional control of the hot surface igniter also increases the power consumption of the appliance, which makes conformance with government regulations regarding power consumption of appliances more and more difficult to meet.

To address such problems with prior hot surface igniter control systems, newer adaptive designs enabled by the use of microprocessor-based electronic controllers have been implemented. Typically, such more modern hot surface ignition control systems will adaptively reduce the energization voltage to the hot surface igniter upon subsequent ignition events to reduce the thermal stress and power consumption of the device. Such adaptation is required because the minimum ignition temperature may vary and depends on several factors such as burner configuration, gas pressure, igniter resistance variations, etc. Unfortunately, such systems have been plagued with a serious problem.

Specifically, prior adaptive controls operate to reduce the voltage applied to the hot surface igniter until the gas can no longer be ignited resulting in a release of un-burnt fuel, and then increase the voltage slightly. That is, upon an initial ignition event, the controller will turn on the energization to the hot surface igniter at a predetermined voltage level, typically its maximum voltage drive, for a short period of time to allow it to reach its maximum temperature, before commanding the gas control valve to open. The electronic controller will then monitor the flame sense circuitry to ensure that the gaseous fuel has been ignited within its ignition period. Upon a second ignition event, the controller will once again energize the hot surface igniter, but at a lower voltage level than the previous level. After the hot surface igniter has been given time to reach its maximum surface temperature at this new, lower, voltage level, the controller will open the gas control valve. The controller will once again monitor the flame sense circuitry to ensure that ignition of the gas occurs within the ignition period.

This process of reducing the drive voltage to the hot surface igniter continues until the gaseous fuel fails to ignite during the ignition period. Once this condition occurs, the ignition controller will allow a purge period to pass before again attempting to turn on the burner. Upon such an attempt, the electronic controller will energize the hot surface igniter at a voltage level greater than the voltage level in the previous ignition attempt during which the gaseous fuel failed to ignite. This process continues until the electronic controller has identified the minimum voltage necessary to drive the hot surface igniter that will ensure ignition of the gaseous fuel during the ignition period.

While such adaptive control is likely to extend the operating life of the hot surface igniter due to the lower drive voltage applied over most of the igniter's life, the adaptive control system itself does result in a release of gaseous fuel during the ignition period which will not be ignited during at least one of the ignition trials. This is because the controller reduces the drive voltage to the hot surface igniter below the point at which the gaseous fuel will ignite. This will result in at least one ignition attempt when gaseous fuel will be released for, typically, four to seven seconds without being ignited by the hot surface igniter. As discussed above, such failure to ignite conditions raise safety concerns, delay operation of the appliance for at least a purge period, and may result in a user believing the appliance has malfunctioned if the user smells the un-combusted gas that has been released for four to seven seconds. In such a situation, the user is liable to lose confidence in the appliance, believe the appliance is malfunctioning, and/or call for unnecessary service that will, as described above, increase the total cost of ownership and decrease the customer satisfaction with the appliance.

In view of the above, there is a need in the art for a hot surface igniter combustion control system that increases the life of the hot surface igniter and that does not result in the un-combusted release of gaseous fuel. Embodiments of the present invention provide for such adaptive control. These and other advantages of the invention, as well as additional inventive features, will be apparent from the description of the invention provided herein.

BRIEF SUMMARY OF THE INVENTION

In view of the above, embodiments of the present invention provide a new and improved adaptive hot surface igniter control method for use in gas burning appliances. More particularly, embodiments of the present invention provide a new and improved method of controlling the energization of a hot surface igniter for a gas appliance that reduces the stress on the hot surface igniter, increases its life, and ensures ignition of gaseous fuel to be combusted therein.

In an embodiment of the present invention, a hot surface ignition method utilizes an adaptive igniter algorithm to determine minimum ignition temperature by monitoring a trial for ignition time. The method does not rely on ignition failure to determine the minimum ignition temperature, and therefore is safer and more efficient than previous designs. Preferably, the method utilizes a preheat sequence to reduce the stress on the hot surface igniter, thus further extending its lifetime.

In one embodiment at the first ignition cycle, the method utilizes a predetermined voltage or power level for the hot surface igniter. If the controller implementing this method detects that flame occurs immediately after the gas valve has been opened, the controller will reduce the power (voltage or current) level to the hot surface igniter on subsequent ignition events until the time for ignition increases to a predetermined time. If, however, the control senses that the time for ignition is longer than a predetermined time, the controller will increase the power level to the hot surface igniter on subsequent ignition events until the time for ignition decreases to the predetermined time.

In another embodiment, the controller will monitor the time for ignition after an initial ignition event. If the controller senses that flame occurs very soon, i.e. less than a predetermined threshold, after the gas valve has been energized, the controller will reduce the period of time during which the hot surface igniter is energized before opening the gas control valve until the time for ignition increases to a predetermined time. If, however, the controller senses that the time for ignition is or has increased beyond a predetermined time, the controller will then increase the period of time during which the hot surface igniter is energized before the gas valve is commanded opened.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In the following description, various embodiments of the method practiced in accordance with the teachings of the present invention will be discussed in relation to the control of a hot surface igniter for use in a consumer or commercial gaseous fuel burning appliance. However, those skilled in the art will recognize from the following description that the application of various embodiments of the method of the present invention may have applicability to other installations, and therefore the discussion below is provided by way of example and not by limitation.

As discussed above, one of the problems with the utilization of a hot surface igniter is that the thermal and mechanical stress resulting from the electrical drive thereof has contributed to early failures of these devices, and prior methods of addressing this problem has resulted in other problems that raise safety concerns. Recognizing this, embodiments of the present invention control the energization of the hot surface igniter to minimize such stresses both at initial turn on and during sustained operation until ignition is confirmed. That is, embodiments of the present invention adaptively tune the control of the energization of the hot surface igniter to determine and use the minimum ignition temperature, that is the minimum temperature necessary to reliably ignite the burner in the particular installation, therefore extending the life of the hot surface igniter.

Unlike prior systems, embodiments of the present invention utilize the length of time required to ignite the gaseous fuel during a trial for ignition period as the mechanism for optimizing the igniter energization. In other words, embodiments of the present invention do not continue to reduce the power to the hot surface igniter until an ignition failure occurs as is common with prior methods. As will be discussed more fully below, such embodiments are effective in extending the operable life of the hot surface igniter without the consequent ignition failure characteristic of prior systems.

Figure 19:
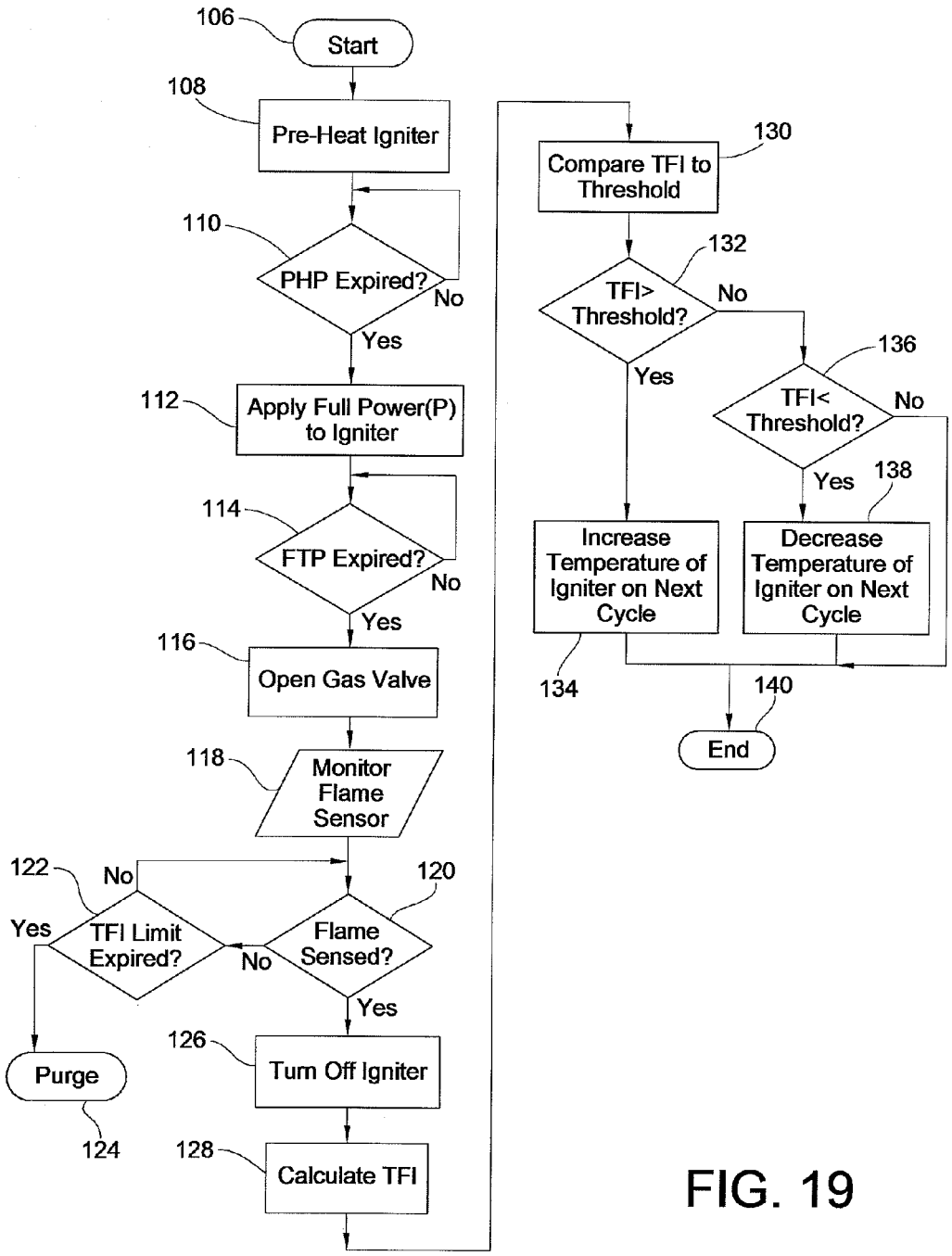
FIG. 19 is a simplified flow diagram of an embodiment of the method of the present invention.

Turning now to the figures, and specifically to FIG. 1, operation of a specific embodiment of the present invention will now be discussed in terms of power flow to the hot surface igniter. The following discussion will also make reference to the functional and decision blocks of the flow diagram of FIG. 19 by parenthetical reference to aid in an understanding of embodiments of the present invention.

Figure 1:
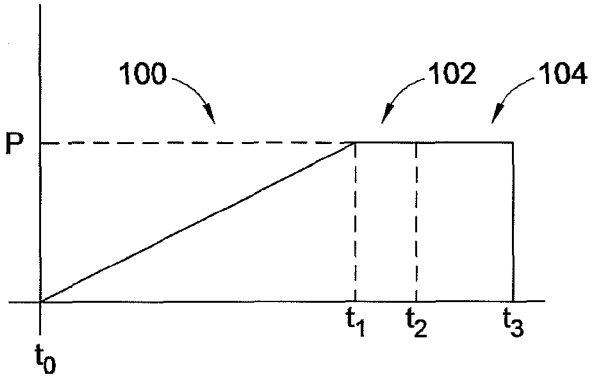
FIGS. 1-18 graphically illustrate the control power flow to a hot surface igniter used in a gas burning appliance under control of various embodiments of the method of the present invention.

As illustrated in FIG. 1, to reduce the initial stress caused by turning on the hot surface igniter, embodiments of the method of the present invention gradually increase the power applied to the igniter during a preheating period (PHP) 100 over a predetermined length of time. This operation is illustrated flow diagrammatically in FIG. 19 once the method has begun 106 as functional block 108. As shown in FIG. 1, this PHP 100 begins at time to and ends at time $t_1$. This gradual increase of the power applied to the hot surface igniter reduces the stress on the igniter, yet allows the igniter to achieve a temperature level just below ignition. This PHP 100 will also reduce the average igniter temperature over its lifetime, thus extending the life of the igniter itself.

Once the PHP 100 has ended at time $t_1$ (see decision block 110), the full temperature period (FTP) 102 begins. During the FTP 102 (functional block 112), which extends from time $t_1$ to time $t_2$ (decision block 114), the hot surface igniter is allowed to heat up to its ignition temperature. Once the FTP 102 has ended at time $t_2$, the controller commands the gas control valve to open to allow gaseous fuel to flow (functional block 116). The period from the opening of the gas valve at time $t_2$ until flame is sensed (decision block 120) or a maximum time has expired (decision block 122 and functional block 124) is the trial for ignition (TFI) period 104. As illustrated in FIG. 1, the TFI 104 ends at time $t_3$ at which point the power to the igniter is turned off (function block 126).

During the initial ignition event of the gas burning appliance in a particular installation, the controller executes this embodiment of the method of the present invention at a power level P sufficient to guarantee ignition of the gaseous fuel.

Once the TFI 104 has begun, the controller will monitor the flame sense circuit to determine when ignition of the gaseous fuel has occurred. The controller then calculates (functional block 128) the period of time that it took for ignition of the gaseous fuel after opening of the fuel control valve and compares this value to a predetermined time threshold (functional block 130). Depending on whether the TFI 104 is longer (decision block 132) or shorter (decision block 136) than the threshold, the method will either increase (functional block 134) or decrease (functional block 138) the temperature of the hot surface igniter on subsequent ignition cycles before ending (block 140).

In one embodiment, if the TFI 104 period of time is shorter than a predetermined threshold, then the controller reduces the temperature of the hot surface igniter by reducing the power output to the hot surface igniter on the next ignition event. This is based on the determination that a rapid ignition of gaseous fuel is a result of a hot surface igniter temperature greater than necessary for the reliable ignition of the gaseous fuel, and therefore an increased stress of the igniter itself. As discussed above, applying more power to the igniter than necessary to ignite the gaseous fuel simply increases unnecessarily the stress on the igniter, which will result in a shortened life span for the device.

Figure 2:
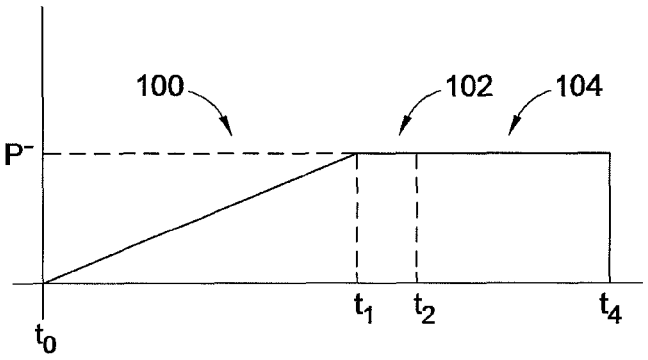

As shown in FIG. 2, on a subsequent ignition event the controller controls the power output to the hot surface igniter at a lower power level $P=(P^-)$, which will result in a lower temperature being achieved. As shown in FIG. 2, the PHP 100 still occurs over the period from time $t_0$ to time $t_1$, and the FTP 102 still occurs during the period from $t_1$ to $t_2$, albeit at a lower power level $P^-$. However, as is also evident from FIG. 2, the lower power output to the hot surface igniter will result in a lengthening of the TFI 104 from the opening of the gas control valve at time $t_2$ until time $t_4$ shown in FIG. 2. As with previous ignition events, the controller will monitor the period of time required for TFI 104, and compare that period to a predetermined time threshold. If the TFI 104 is still shorter than the predetermined threshold, the controller will again reduce the amount of power supplied so that the stress on the igniter continues to be reduced while still ensuring ignition of the gaseous fuel.

Figure 3:
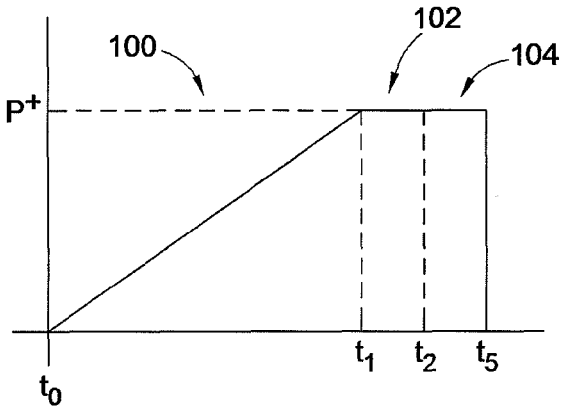

However, if the TFI 104 is longer than the predetermined threshold, the controller determines that the power supplied to the hot surface igniter has resulted in a temperature that is less than can be reliably ensured to result in ignition of the gaseous fuel on each attempt. As such, the method then increases the amount of power supplied to the hot surface igniter $P=(P^+)$ as shown in FIG. 3. At this new, higher power level $P^+$, the TFI 104 is shortened as illustrated by time $t_5$, resulting from a quicker ignition of the gaseous fuel based on the higher temperature achieved by the hot surface igniter as a result of the increased power supplied thereto.

In one embodiment this process continues on each ignition event to ensure that optimal operation of the hot surface igniter is maintained over the life of the appliance installation. Such changes may be the result of aging components, changes in gas pressure during different periods of the year and/or times of the day, etc. It should be noted, that while FIGS. 1-3 illustrate a constant PHP 100 with a varying slope of the application of the power to the hot surface igniter during the PHP 100, an alternate embodiment may utilize the same slope of power application, and merely start the FTP 102 earlier or later once the desired power level has been achieved.

Figure 4:
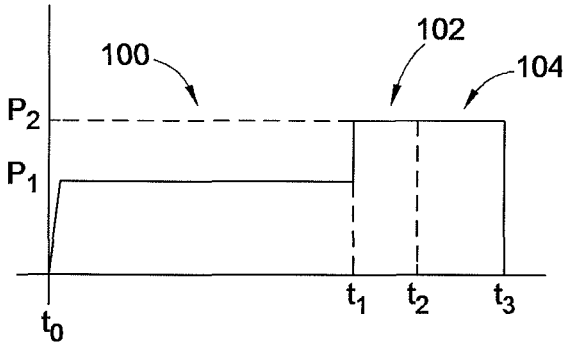

An alternate embodiment of the present invention utilizes a different approach to the power regulation during the ignition events. Specifically, as illustrated in FIG. 4, in this embodiment the power applied to the hot surface igniter during the PHP 100 (functional block 108) is turned on to a power level less than the power level that will be applied during the FTP 102 and TFI 104 periods. This is illustrated in FIG. 4 by power level $P_1$. Once the PHP 100 has ended at time $t_1$, the power to the hot surface igniter is then increased to the desired power level $P_2$ during the FTP 102 (functional block 112) to allow the hot surface igniter to heat up to ignition temperature. At the end of the FTP 102, at time $t_2$, the gas control valve will be commanded open as discussed above. As with the previous embodiment, the duration of the TFI 104 is monitored and compared to a predetermined threshold.

Figure 5:
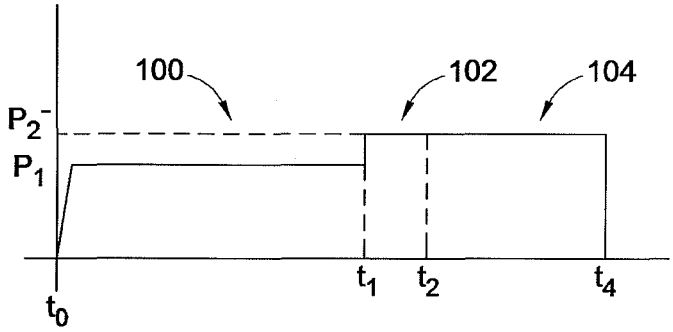

If the TFI 104 is shorter than the predetermined threshold, the power applied during the FTP 102 and TFI 104 periods is reduced to $P=(P_2^-)$ as illustrated in FIG. 5 to decrease the temperature of the igniter on the next cycle (functional block 138). As a result of the lower power application to the hot surface igniter, the TFI 104 increases as illustrated by time $t_4$. As discussed above, this new TFI 104 time will be compared to the threshold and further reductions in power will occur if the TFI 104 time is shorter than the predetermined threshold.

Figure 6:
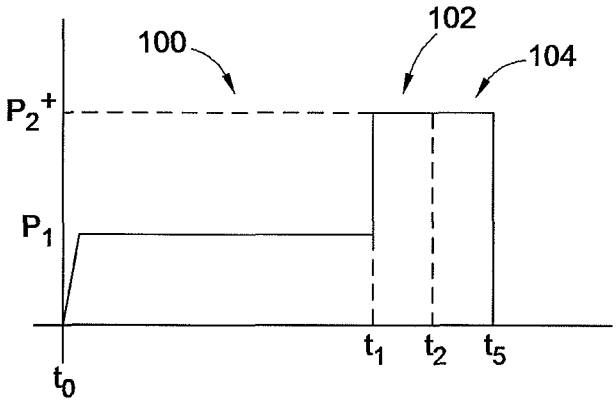

However, as illustrated in FIG. 6, if the TFI 104 of a previous ignition event was longer than the predetermined threshold, signifying that a reliable ignition cannot be guaranteed, the amount of power $P=(P_2^+)$ applied during the FTP 102 and TFI 104 periods is increased (functional block 134). As is clear from this illustration, the increased power will result in a quicker ignition of the gaseous fuel as indicated by time $t_5$. As with the previous embodiment, the adaptation made possible by the method of the present invention may continue for each ignition event to continuously fine tune the ignition control as the system ages and as external conditions vary.

Figure 7:
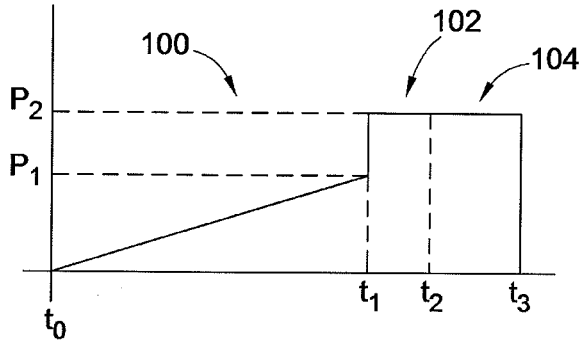
Figure 8:
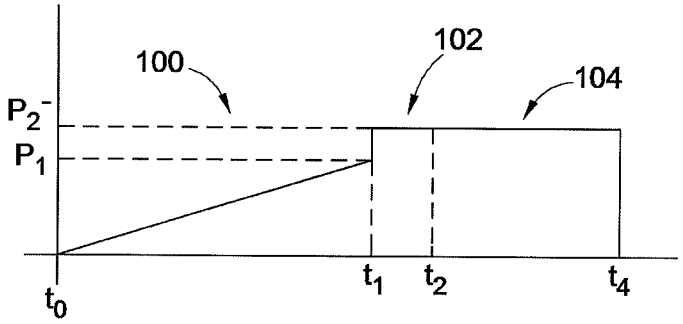
Figure 9:
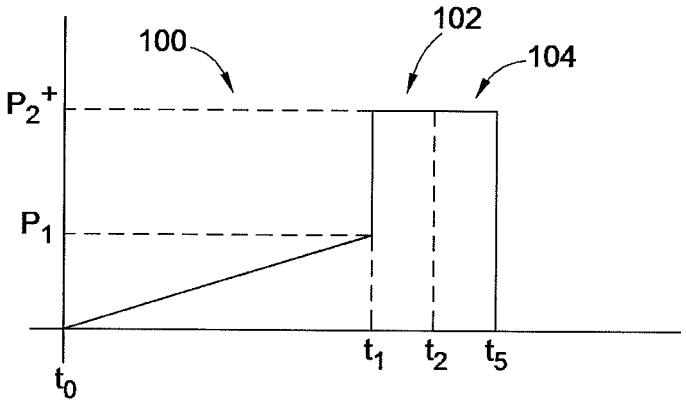
Figure 10:
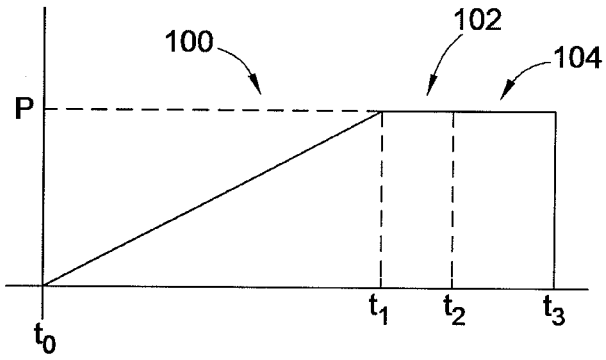
Figure 11:
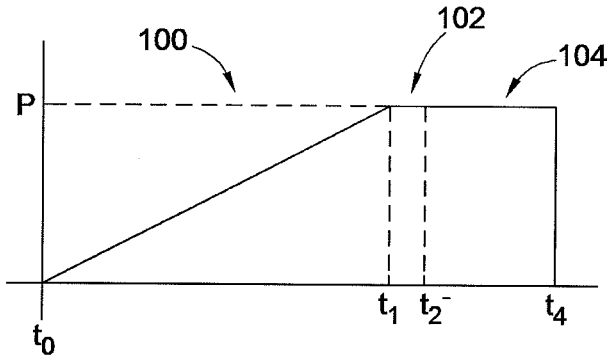
Figure 12:
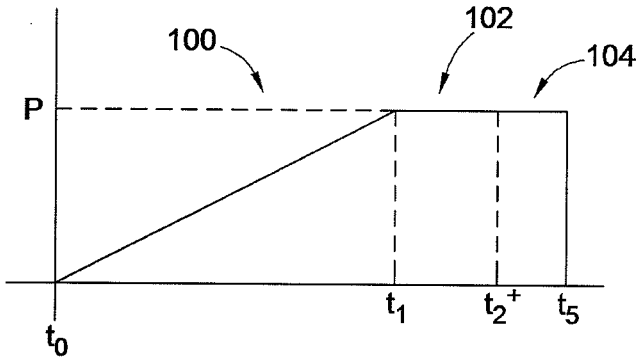
Figure 13:
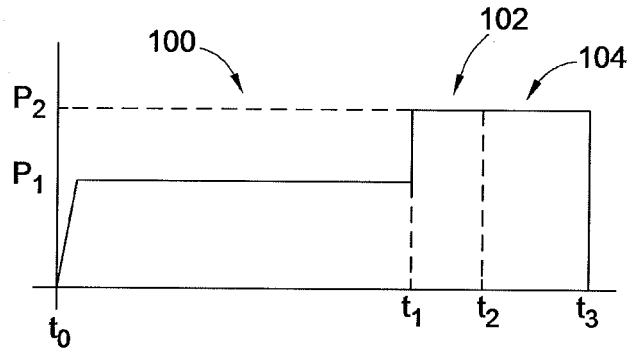
Figure 14:
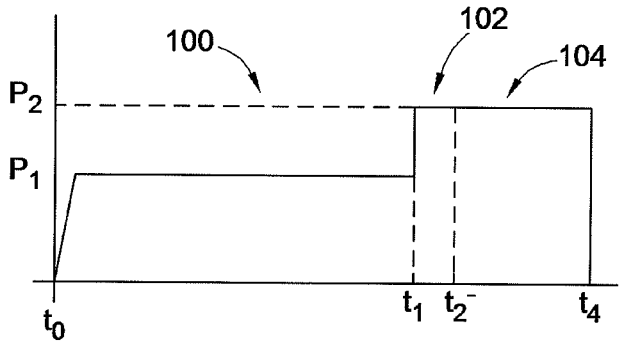
Figure 15:
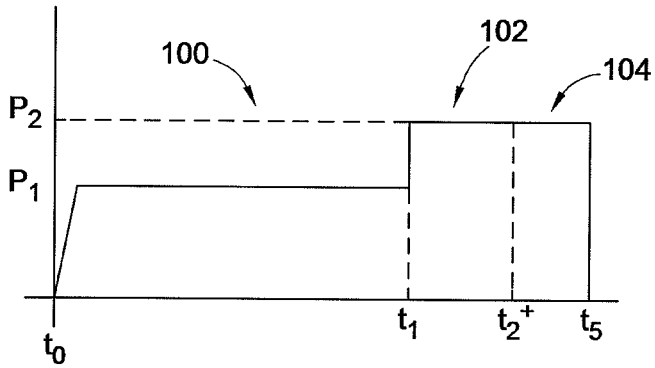
Figure 16:
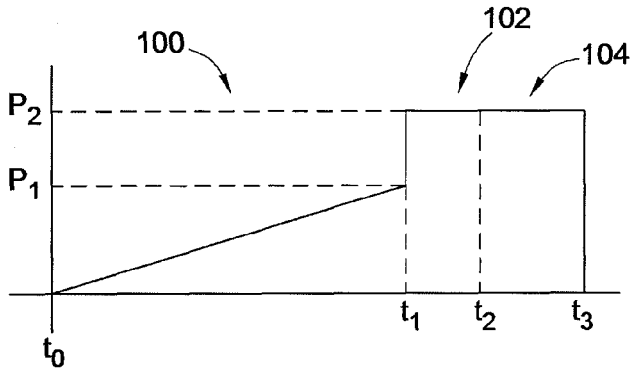
Figure 17:
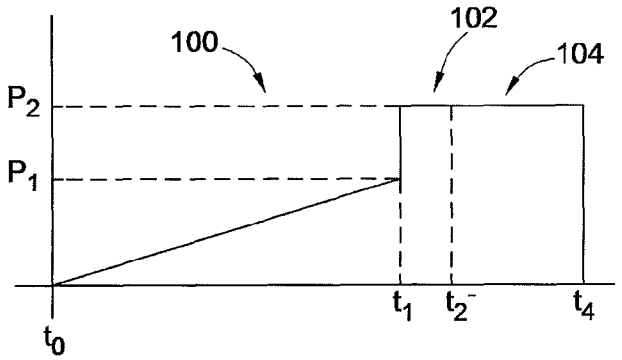
Figure 18:
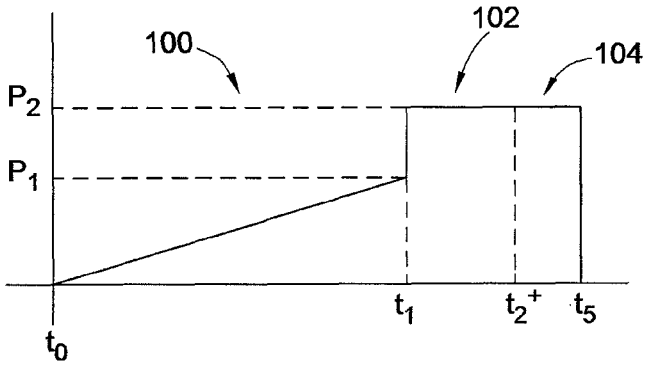

In an alternate embodiment of the present invention, illustrated operationally in FIGS. 7-9, the control of the power applied to the hot surface igniter during the PHP 100 applies a varying amount of power during the period from time $t_0$ to time $t_1$, but then increases to the preheat power level $P_1$ similar to that discussed above with regard to FIGS. 4-6. Once the FTP 102 has begun at time $t_1$, the power level to the hot surface igniter is switched to the $P_2$ (or $P_2^-$, $P_2^+$) depending on how long the system has been operating and the relation of the previous TFI to the threshold.

This is not to say, however, that only three power levels are available for adapting the control of the hot surface igniter. Indeed, embodiments of the present invention may utilize incremental small steps of power increase or decrease between ignition events to vary the power provided to the hot surface igniter so as to fine tune the power applied. Indeed, the granularity of the adjustment between ignition events may also be variable in certain embodiments of the present invention such that, for example, when a difference between the sensed TFI 104 and the predetermined threshold is greater than a second predetermined threshold, the adjustment to the power level will be increased at a greater rate between ignition events than when the difference between the sensed TFI 104 and the predetermined threshold is smaller. Such an embodiment will allow the method of the present invention to more quickly achieve the proper power level to be applied to the hot surface igniter while still allowing an acceptable settling time for the control.

In alternate embodiments of the present invention, as illustrated in FIGS. 10-12, 13-15, and 16-18, the control varies the period of time of the FTP 102 instead of the power level itself to increase (functional block 134) or decrease (functional block 138) the temperature of the igniter on the next cycle. That is, the period of time between application of the control power P to the hot surface igniter at time $t_1$ until the gas control valve is commanded open at time $t_2$. As illustrated in these figures, at the first ignition cycle the controller utilizes a predetermined period of time from time $t_1$ to time $t_2$ for the application of the power P for the FTP 102. However, if the controller senses that the flame ignites too soon after the gas has been energized, the controller will reduce the FTP 102 time such that it ends at time $t_2^-$. This will result in an increase in the TFI 104 period until time $t_4$ due to the less total power supplied to the hot surface igniter. Alternatively, if the controller senses that the TFI 104 time is longer than the predetermined threshold, the controller will increase the FTP 102 time until time $t_2^+$. This will result in a shorter TFI 104 that ends at time $t_5$ due to the increase in total power supplied to the hot surface igniter.

As discussed above, the amount in time variation may occur in uniform steps at each ignition event, or may vary in magnitude based upon the size of the difference between the actual ignition time and the predetermined threshold.

It should be recognized by those skilled in the art from the foregoing description that further alternate embodiments of the present invention that combine the power variation with the FTP 102 period variation are also within the scope of the present invention. For example, in one embodiment the FTP 102 is limited both to a minimum period and to a maximum period beyond which variations are not allowed. However, if the FTP 102 is at its minimum setting and the TFI 104 is still shorter than the predetermined threshold, an embodiment of the present invention will then reduce the power applied to the hot surface igniter until the TFI 104 approaches the predetermined threshold. Similarly, if the FTP 102 is at its maximum and the TFI 104 is still longer than the predetermined threshold, an embodiment of the present invention will increase the power supplied to the hot surface igniter to bring the TFI 104 down to the acceptable level. In other embodiments, the method may allow the power to be varied between a maximum and a minimum setting, and may then vary the FTP 102 if the TFI 104 time is too long or too short. Further embodiments may simultaneously or alternately vary these two control parameters to achieve optimal performance.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of increasing an operational life of a hot surface igniter used to ignite gaseous fuel in a gas appliance, comprising the steps of:

pre-heating the hot surface igniter during a pre-heat period (PHP);

energizing the hot surface igniter at a power level P during a full temperature period (FTP);

opening a gas control valve at the expiration of the FTP;

monitoring for a presence of flame;

de-energizing the hot surface igniter when the step of monitoring determines that flame is present;

determining a trial for ignition (TFI) period, the TFI being the length of time required for ignition to occur once the FTP has expired;

comparing the TFI to a predetermined time threshold; and increasing a temperature of the hot surface igniter on a subsequent ignition event when the step of comparing determines that the TFI is longer than the predetermined time threshold; and decreasing the temperature of the hot surface igniter on a subsequent ignition event when the step of comparing determines that the TFI is shorter than the predetermined time threshold.

2. The method of claim 1, wherein the step of pre-heating comprises the step of increasing power supplied to the hot surface igniter over the entire PHP.

3. The method of claim 2, wherein the step of increasing power supplied to the hot surface igniter over the entire PHP comprises the step of linearly increasing the power supplied.

4. The method of claim 1, wherein the step of pre-heating comprises the step of turning on the power supplied to the hot surface igniter to a level less than the power level P during the PHP.

5. The method of claim 1, wherein the step of pre-heating comprises the step of increasing power supplied to the hot surface igniter over the entire PHP to a level less than the power level P.

6. The method of claim 1, wherein the step of increasing a temperature of the hot surface igniter on a subsequent ignition event comprises the step of increasing the power level supplied during the step of energizing from P to $P^+$.

7. The method of claim 1, wherein the step of increasing a temperature of the hot surface igniter on a subsequent ignition event comprises the step of increasing a duration of the FTP.

8. The method of claim 1, wherein the step of increasing a temperature of the hot surface igniter on a subsequent ignition event comprises the steps of performing at least one of the steps of increasing the power level supplied during the step of energizing from P to $P^+$ and increasing a duration of the FTP.

9. The method of claim 1, wherein the step of decreasing a temperature of the hot surface igniter on a subsequent ignition event comprises the step of decreasing the power level supplied during the step of energizing from P to $P^-$.

10. The method of claim 1, wherein the step of decreasing a temperature of the hot surface igniter on a subsequent ignition event comprises the step of decreasing a duration of the FTP.

11. The method of claim 1, wherein the step of decreasing a temperature of the hot surface igniter on a subsequent ignition event comprises the steps of performing at least one of the steps of decreasing the power level supplied during the step of energizing from P to $P^+$ and decreasing a duration of the FTP.

12. A method of controlling a hot surface igniter used in a gas appliance, comprising the steps of:

pre-heating the hot surface igniter during a pre-heat period (PHP);

energizing the hot surface igniter at a power level P during a full temperature period (FTP);

commanding a gas control valve to open at the expiration of the FTP, the TFI being the length of time required for ignition to occur once the FTP has expired;

monitoring for a presence of flame;

determining a trial for ignition (TFI) time;

comparing the TFI to a predetermined time threshold; and increasing the power level supplied during the step of energizing from P to $P^+$ on a next ignition event when the step of comparing determines that the TFI is longer than the predetermined time threshold; and decreasing the power level supplied during the step of energizing from P to $P^-$ on a next ignition event when the step of comparing determines that the TFI is shorter than the predetermined time threshold.

13. The method of claim 12, wherein the step of preheating comprises the step of increasing power supplied to the hot surface igniter over the entire PHP.

14. The method of claim 13, wherein the step of increasing power supplied to the hot surface igniter over the entire PHP comprises the step of linearly increasing the power supplied.

15. The method of claim 12, wherein the step of preheating comprises the step of turning on the power supplied to the hot surface igniter to a level less than the power level P during the PHP.

16. The method of claim 12, wherein the step of preheating comprises the step of increasing power supplied to the hot surface igniter over the entire PHP to a level less than the power level P.

* * * * *